US005862868A

United States Patent [19]

Yamamoto et al.

[11] Patent Number: 5,862,868

[45] Date of Patent: Jan. 26, 1999

[54] BULLDOZER BLADE PITCH CONTROL METHOD AND CONTROLLER FOR THE SAME

[75] Inventors: Shigeru Yamamoto; Nobuhisa Kamikawa; Toshikazu Okada, all of Hirakata; Noriaki Namiki, Kyoto, all of Japan

[73] Assignee: Komatsu Ltd., Tokyo, Japan

[21] Appl. No.: 884,945

[22] Filed: Jun. 30, 1997

[51] Int. Cl.[6] ..... E02F 3/76

[52] U.S. Cl. ..... 172/2; 172/812; 172/831; 701/50

[58] Field of Search ..... 172/2, 5, 6, 12, 172/810, 811, 812, 831; 701/50

[56] References Cited

U.S. PATENT DOCUMENTS

| | | | |
|---|---|---|---|
| 5,503,232 | 4/1996 | Matsushita et al. | 172/2 |
| 5,560,431 | 10/1996 | Stratton | 172/2 |
| 5,620,053 | 4/1997 | Kamikawa et al. | 172/2 X |

FOREIGN PATENT DOCUMENTS 3- 50646 5/1991 Japan .

*Primary Examiner*—Christopher J. Novosad
*Attorney, Agent, or Firm*—Sidley & Austin

[57] ABSTRACT

A bulldozer blade (10) is automatically reset to a predetermined excavating pitch while the bulldozer (20) is traveling backwardly after it has completed an operation of excavating, carrying, or dumping earth. The bulldozer blade (10) can be set to an excavating pitch, a carrying pitch, or a dumping pitch when excavating, carrying, or dumping earth while the bulldozer is traveling forwardly, the bulldozer blade being attached to the leading ends of frame members (15A, 15B) which are pivotally mounted on opposite sides of the vehicle body (20*a*) in such a manner that the bulldozer blade can swing longitudinally. The rotational angles of left and right lifting cylinders (21A, 21B), which are attached to the bulldozer blade, are detected by first detectors (23*a*, 23*b*) while the bulldozer is traveling backwardly after it has completed an operation of excavating, carrying, or dumping earth, and the bulldozer blade is automatically reset to a predetermined excavating pitch from the carrying pitch or the dumping pitch in response to a command issued by a controller (50) which receives detection signals from the first detectors.

13 Claims, 11 Drawing Sheets

BULLDOZER BLADE PITCH CONTROL METHOD AND CONTROLLER FOR THE SAME

BACKGROUND OF THE INVENTION

1. Field of the Invention

The present invention relates to a bulldozer blade pitch control method and a controller for the same, for automatically resetting a bulldozer blade to a predetermined excavating pitch while the bulldozer is traveling backwardly after the bulldozer has completed an operation of excavating, carrying, or dumping earth.

2. Description of Related Art

As shown in FIG. 3, a bulldozer 20, which is equipped with a bulldozer blade 10, has a left frame member 15A and a right frame member 15B which are pivotally attached to the right and left sides of the vehicle body 20*a* of the bulldozer 20 such that they can swing, the bulldozer blade 10 being pivotally installed on the leading ends of the frame members 15A and 15B so that the bulldozer blade 10 can swing longitudinally. The left end portion of the bulldozer blade 10 is pivotally connected to one end of the left pitching cylinder 20A, while the other end of the left pitching cylinder 20A is connected to an intermediate portion of the left frame member 15A. Similarly, the right end portion of the bulldozer blade 10 is pivotally connected to one end of the right pitching cylinder 20B, while the other end of the right pitching cylinder 20B is connected to an intermediate portion of the right frame member 15B.

The left portion of the bulldozer blade 10 is also pivotally connected to the left front portion of the vehicle body 20*a* by the left lifting cylinder 21A, while the right portion of the bulldozer blade 10 is also pivotally connected to the right front portion of the vehicle body 20*b* by the right lifting cylinder 21B. The lifting cylinders 21A and 21B can be extended or retracted simultaneously so as to raise or lower the bulldozer blade 10 as indicated by the arrow A in FIG. 3. The pitching cylinders 20A and 20B can be extended or retracted simultaneously to pitch the bulldozer blade 10 forwardly for dumping or backwardly as indicated by the arrow B in FIG. 3.

In a conventional bulldozer, for example, as proposed in Japanese Unexamined Utility Model Publication No. 3-50646, the bulldozer blade is raised, lowered, and pitched by a single control lever and a single tilting or pitching selector switch.

When the bulldozer excavates while traveling forwardly, the bulldozer blade is pitched at an excavation angle. When the bulldozer carries earth while traveling forwardly, the bulldozer blade is pitched backwardly from the excavating angle to a carrying pitch, also known as a back pitch. The term "earth" is considered to be generic to dirt, sand, rocks, debris, etc., which can be excavated and carried by a bulldozer. When the bulldozer dumps earth while traveling forwardly, the bulldozer blade is forwardly from the excavating angle to a dumping pitch. However, when an operator of the bulldozer returns to an original excavating point by traveling the bulldozer backwardly after completing such carrying or dumping work, the operator is required to simultaneously operate both the control lever for steering the bulldozer and a working machine lever for resetting the bulldozer blade to the original excavating pitch. This makes the operation complicated, which is undesirable from a safety standpoint.

SUMMARY OF THE INVENTION

The present invention has been made with a view toward solving the problem described above, and it is an object thereof to provide a bulldozer blade pitch control method and a controller for the same, for automatically resetting a bulldozer blade to a predetermined excavating pitch while a bulldozer is traveling backwardly after it has finished an operation of excavating, carrying, or dumping earth.

To this end, according to a first aspect of the present invention, there is provided a bulldozer blade pitch control method for setting the bulldozer blade to an excavating pitch, a carrying pitch, or a dumping pitch when excavating, carrying, or dumping earth while the bulldozer is traveling forwardly, the bulldozer blade being attached to the leading ends of frame members which are pivotally mounted on opposite sides of the vehicle body in such a manner that the bulldozer blade can swing longitudinally, the bulldozer blade being attached to the vehicle body by left and right lifting cylinders, wherein the rotational angles of the left and right lifting cylinders are detected by first detectors while the bulldozer is traveling backwardly after the bulldozer has completed an operation of excavating, carrying, or dumping earth, and the bulldozer blade is automatically reset, from the carrying pitch or the dumping pitch to a predetermined excavating pitch for the next excavation to be performed during a subsequent forward travel, in response to a command issued by a controller which receives detection signals from the first detectors.

In the foregoing method, when the bulldozer blade is being raised or when it reaches a predetermined height from the ground surface while the bulldozer is traveling backwardly, the bulldozer blade is automatically reset to the predetermined excavating pitch.

Further in the foregoing method, when a command is received via a carrying pitch switch, for setting the bulldozer blade to the carrying pitch, or via a dumping pitch switch, for setting the bulldozer blade to the dumping pitch, while the bulldozer is traveling backwardly, the bulldozer blade is automatically reset to the predetermined excavating pitch.

Furthermore, in the foregoing method, if a command other than one for backward travel is supplied to the transmission when the bulldozer blade is being reset to the excavating pitch while the bulldozer is traveling backwardly, then the resetting of the bulldozer blade to the excavating pitch is interrupted.

According to a second aspect of the present invention, there is provided a bulldozer blade pitch control method for setting a bulldozer blade to an excavating pitch, a carrying pitch, or a dumping pitch, when excavating, carrying, or dumping earth, by turning ON a carrying pitch switch or a dumping pitch switch while the bulldozer is traveling forwardly, the bulldozer blade being attached to the leading ends of frame members which are pivotally mounted on opposite sides of the vehicle body in such a manner that the bulldozer blade can swing longitudinally; wherein the resetting of the bulldozer blade to the excavating pitch is interrupted if the carrying pitch switch or the dumping pitch switch is pressed again and released when the bulldozer blade is being automatically reset from the carrying pitch or the dumping pitch to the predetermined excavating pitch while the bulldozer is traveling backwardly after it has completed an operation of excavating, carrying, or dumping earth.

A bulldozer blade pitch controller, according to a third aspect of the present invention, sets a bulldozer blade to an excavating pitch, a carrying pitch, or a dumping pitch when excavating, carrying, or dumping earth while the bulldozer is traveling forwardly; the bulldozer blade being installed at the leading ends of frame members attached on opposite sides of the vehicle body; the bulldozer blade pitch controller being equipped with: first detectors for detecting if the bulldozer blade is in the excavating pitch, in the carrying pitch, or in the dumping pitch; second detectors for detecting if a transmission mounted on the bulldozer has been set for forward or backward travel and for detecting the position of a speed gear; and a controller for supplying commands, in response to the signals received from the first and second detectors, to an electromagnetic hydraulic controller for setting the bulldozer blade to the predetermined excavating pitch while the bulldozer is traveling backwardly.

The foregoing bulldozer blade pitch controller can be further provided with third detectors, for detecting a raising operation of the bulldozer blade or the height of the bulldozer blade from the ground surface, and a controller for supplying, in response to the signals received from the first, second, and third detectors, a command to the electromagnetic hydraulic controller which sets the bulldozer blade to a predetermined pitch while the bulldozer is traveling backwardly.

The foregoing bulldozer blade pitch controller or a controller which has the third detectors added to the foregoing bulldozer blade pitch controller can be further provided with fourth detectors, for detecting the tractive force of the bulldozer while the bulldozer excavates or carries earth, and a controller for issuing a command to the electromagnetic hydraulic controller which sets the bulldozer blade to the predetermined excavating pitch if the detected tractive force is equal to or greater than a predetermined value and the transmission is shifted to a reverse position from the neutral position within a predetermined time so that the bulldozer begins to travel backwardly.

In such an arrangement, the rotational angles of the right and left lifting cylinders for the bulldozer blade are detected beforehand by the first detectors; and the target values of the excavating pitch, the carrying pitch, and the dumping pitch of the bulldozer blade are calculated by the controller from the mean values of the rotational angles; and the calculated target values are stored. While the bulldozer is traveling backwardly after it has completed an operation of excavating, carrying, or dumping earth, the then current rotational angles are detected, and the current detection signals are compared with the target values by the controller so as to issue a command, thereby automatically resetting the bulldozer blade from the carrying pitch or the dumping pitch to the predetermined excavating pitch required for the next excavation to be carried out during a subsequent forward travel. Whether or not the bulldozer is traveling backwardly can be determined by detecting the pressure of the reverse clutch of the transmission via the second detectors.

When the bulldozer carries or dumps earth while traveling forwardly, the bulldozer blade is switched from the excavating pitch to the carrying pitch or the dumping pitch. Then, when the bulldozer travels backwardly to return to an original excavating point, the bulldozer blade pitch controller issues a command to the electromagnetic hydraulic controller of the bulldozer blade to automatically reset the bulldozer blade to the predetermined excavating pitch. This completely obviates the need for the operator to manipulate the working machine lever, thereby enabling the operator to concentrate on looking behind the bulldozer to check for any obstacles and also on operating the steering lever. Thus, the ease of operation and the safety of the bulldozer can be improved.

The bulldozer blade is raised when the bulldozer moves backwardly after finishing an operation of excavating, carrying, or dumping earth. The rise of the bulldozer blade is checked by detecting the height of the bulldozer blade above the ground surface from the strokes of the right and left lifting cylinders or by detecting the pilot pressures of the selector valves of the right and left lifting cylinders via the third detectors. This prevents the bulldozer blade from unexpectedly moving against the operator's will while the bulldozer is traveling backwardly, thereby ensuring a safe, positive, automatic resetting of the bulldozer blade to the predetermined excavating pitch.

A turning ON of the carrying pitch switch or the dumping pitch switch, while the bulldozer is traveling backwardly, allows the bulldozer blade to be reset to the predetermined excavating pitch. When resetting the bulldozer blade to the excavating pitch, if a command other than a command for backward travel is supplied to the transmission, then the resetting of the bulldozer blade to the excavating pitch can be interrupted, thus contributing to safety.

Moreover, when the bulldozer blade is being automatically reset to the predetermined excavating pitch while the bulldozer is traveling backwardly, if the carrying pitch switch or the dumping pitch switch is pressed again and released, then the resetting of the bulldozer blade to the excavating pitch can be interrupted, thus further contributing to safety.

DETAILED DESCRIPTION OF THE PREFERRED EMBODIMENTS

A bulldozer blade pitch controller in accordance with an embodiment of the present invention will be described in detail with reference to FIGS. 1 through 5.

Figure 1:
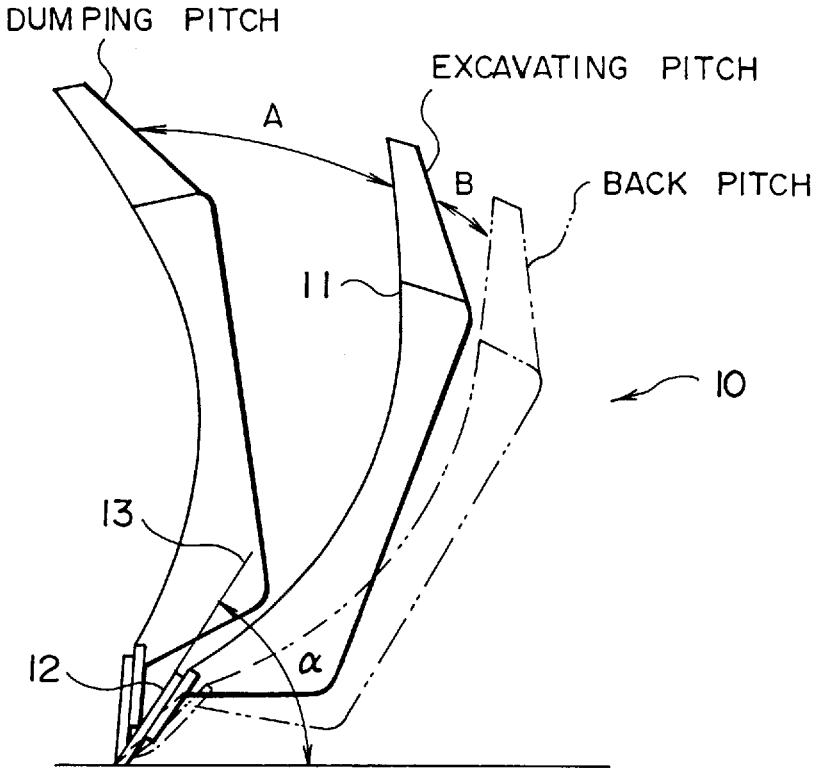
FIG. 1 is a schematic representation of the excavating pitch, the dumping pitch, and the carrying pitch of a bulldozer blade.

A bulldozer blade 10 has a blade tip 12 which is mounted at the bottom edge of a front faceplate 11, the faceplate 11 being formed by a concave surface as illustrated in FIG. 1. The blade tip angle α is the angle between the horizon and a line 13 which is in a vertical plane and in the front face of the blade tip 12. The blade tip angle α for the excavating pitch of the bulldozer blade 10 is approximately 55 degrees. When the bulldozer blade 10 is inclined forwardly from the excavating pitch by an amount indicated by the arrow A, the bulldozer blade 10 is set at the dumping pitch. Conversely, when the bulldozer blade 10 is inclined backwardly from the excavating pitch by an amount indicated by the arrow B, the bulldozer blade 10 is set at the back or carrying pitch.

When excavating, carrying, and dumping earth, the bulldozer blade 10 is first set at the excavating pitch, i.e., the blade tip α is set to approximately 55 degrees to the horizon, to excavate earth. When the front faceplate 11 of the bulldozer blade 10 gathers earth, the bulldozer blade 10 is tilted further backwardly to set it at the carrying pitch so as to enable the bulldozer blade 10 to carry more of the gathered earth. After carrying the earth for the desired distance, the bulldozer blade 10 is inclined forwardly to set it at the dumping pitch in order to dump the earth.

Figure 2:
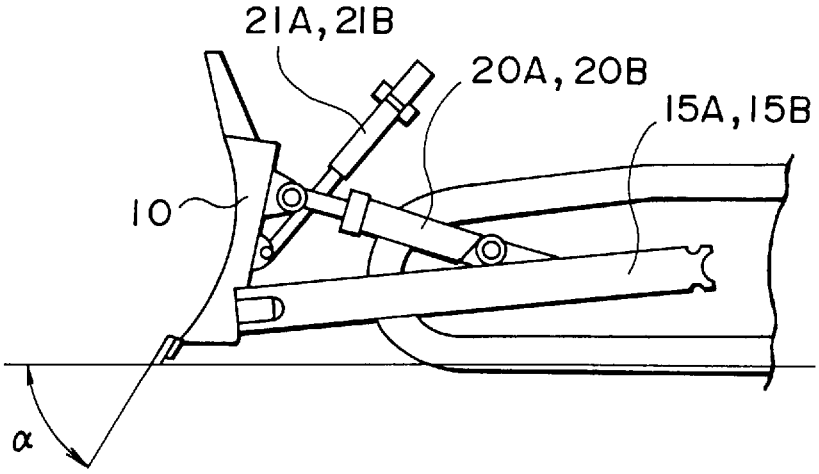
FIG. 2 is a schematic representation of the bulldozer blade of FIG. 1, which blade has been attached to a bulldozer.

FIG. 2 illustrates the bulldozer blade 10 attached to a bulldozer 20 which is equipped with: the left frame member 15A and the right frame member 15B, which pivotally support the bulldozer blade 10 in such a manner that the bulldozer blade 10 can swing; the left lifting cylinder 21A and the right lifting cylinder 21B, for raising or lowering the bulldozer blade 10; and the left pitching cylinder 20A and the right pitching cylinder 20B, for shifting the bulldozer blade 10 from the excavating pitch to the dumping pitch or the carrying pitch and from the dumping pitch or the carrying pitch to the excavating pitch.

Figure 3:
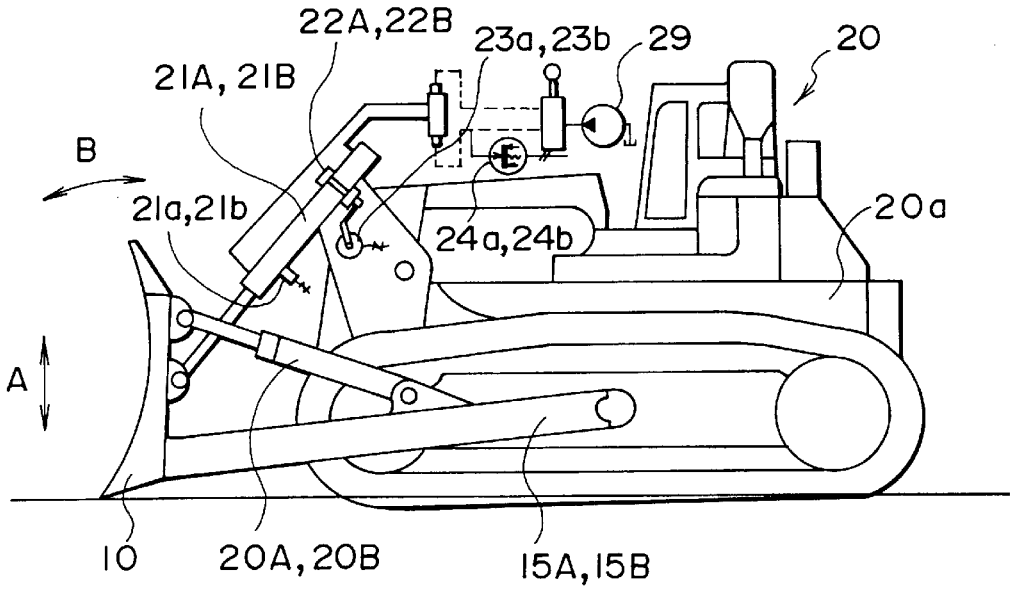
FIG. 3 is a side view of a bulldozer to which sensors in accordance with an embodiment of the present invention have been attached.

As shown in FIG. 3, the bulldozer 20 has yokes 22A and 22B, which are rotatably mounted on the front right portion and the front left portion of the vehicle body 20*a*, respectively. One end of the left lifting cylinder 21A is fixed to the yoke 22A, and one end of the right lifting cylinder 21B is fixed to the yoke 22B, the other ends of the lifting cylinders 21A and 21B being pivotally fixed to the bulldozer blade 10. Yoke angle sensors 23*a* and 23*b* (first detectors), for detecting the rotational angles of the yokes 22A and 22B, are installed on the right and left side portions of the vehicle body 20*a*, respectively. The left and right lifting cylinders 21A and 21B include stroke sensors 21*a* and 21*b* for detecting the strokes of the left and right lifting cylinders 21A and 21B, respectively, and pilot pressure sensors 24*a* and 24*b* (third detectors), for detecting the pilot pressures of the selector valves for switching the pressurized oil thereof.

Figure 4:
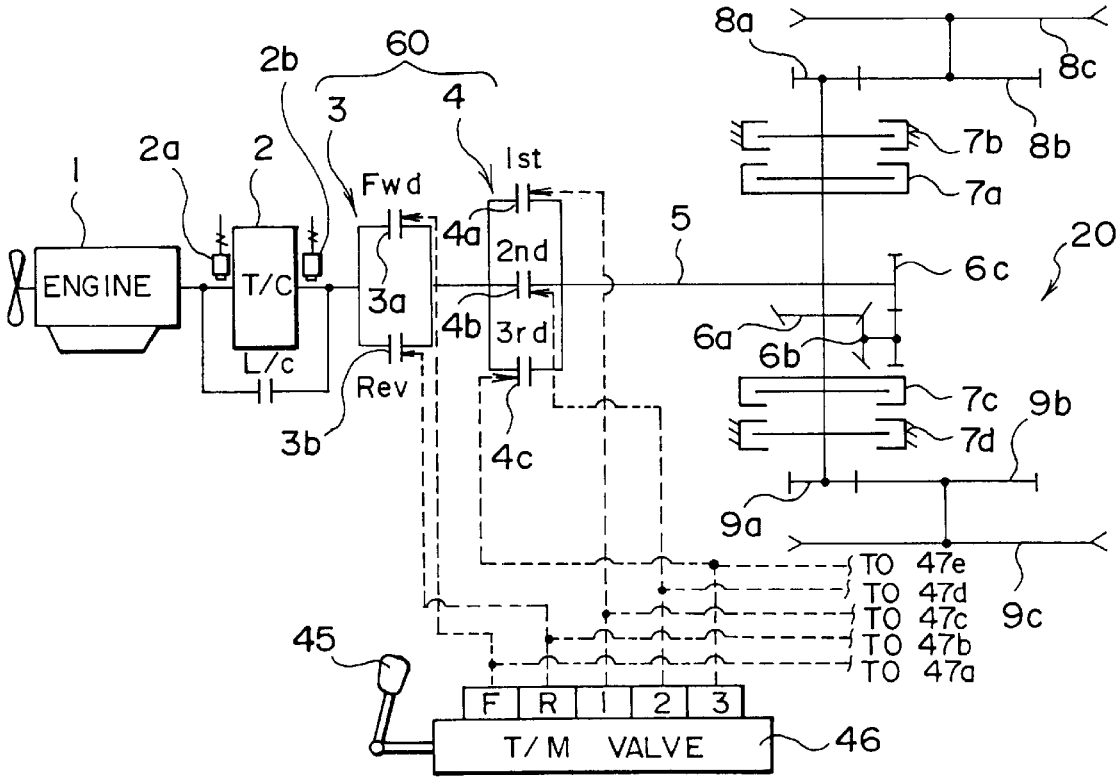
FIG. 4 is a schematic representation of a power line of the bulldozer, on which the sensors in accordance with the embodiment have been mounted.

FIG. 4 illustrates the power line of the bulldozer 20. The output of an engine 1 is transmitted to a transmission (T/M) 60, which is composed of a forward/reverse travel clutch 3 and a speed clutch 4, via a torque converter (T/C) 2. Between the input and output shafts of the torque converter 2, there is provided a lockup clutch (L/C) for directly connecting the input and output shafts. The output from the transmission 60 is transmitted to a bevel pinion 6*b* via a drive gear 6*c* connected to a drive shaft 5, and from a bevel gear 6*a*, it is transmitted to the right and left drive systems. To be more specific, the power transmitted via the left and right steering clutches 7*a* and 7*c* and the left and right steering brakes 7*b* and 7*d* is slowed down via first gears 8*a* and 9*a* and the second gears 8*b* and 9*b* of the right and left final speed reducers before it is transmitted to the left and right drive wheels 8*c* and 9*c*.

A transmission lever 45 is operated to control a transmission valve 46 so as to disengage or engage the forward/reverse travel clutch 3 and the speed clutch 4. More specifically, a hydraulic command issued from the transmission valve 46 is supplied to a forward (F) clutch 3*a*, a reverse (R) clutch 3*b*, a first speed clutch 4*a*, a second speed clutch 4*b*, and/or a third speed clutch 4*c*. Hydraulic sensors 47*a*, 47*b*, 47*c*, 47*d*, and 47*e* (second detectors), for detecting oil pressures, are installed in respective hydraulic lines between the transmission valve 46 and the clutches 3*a*, 3*b*, 4*a*, 4*b*, and 4*c*; the signals from the hydraulic sensors 47*a*, 47*b*, 47*c*, 47*d*, and 47*e* are supplied to a bulldozer blade pitch controller 50 which will be discussed later.

A torque converter input revolution number sensor 2*a*, for detecting the number of revolutions per minute of the input shaft, is installed between the engine 1 and the torque converter 2; and a torque converter output revolution number sensor 2*b*, for detecting the number of revolutions per minute of the output shaft, is installed between the torque converter 2 and the transmission 60. The signals issued from the revolution number sensors 2*a* and 2*b* (fourth detectors) are also applied to the bulldozer blade pitch controller 50 which will be discussed later.

Figure 5:
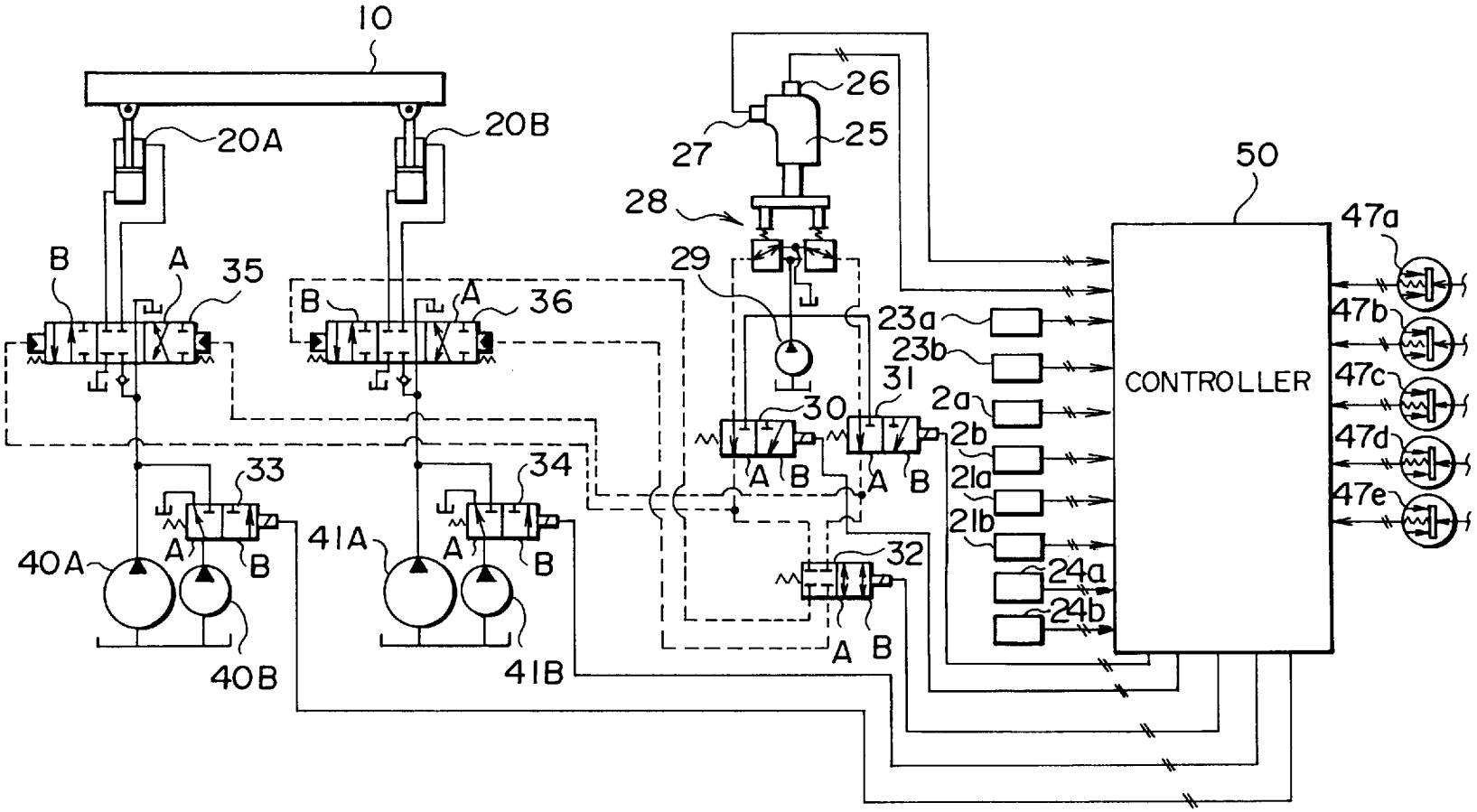
FIG. 5 is a diagram illustrative of an electromagnetic hydraulic circuit for controlling the pitch of a bulldozer blade in accordance with the embodiment.

FIG. 5 is a diagram of the circuit for controlling the pitch of the bulldozer blade 10 according to the embodiment; it illustrates only a pitch control circuit, a lifting control circuit having been omitted since it is the same as that of a conventional one. The discharge pipe of a first fixed capacity type hydraulic pump 40A is connected to a first direction control valve 35. The discharge pipe of a second fixed capacity type hydraulic pump 41A is connected to a second direction control valve 36. These discharge pipes are respectively connected to the left and right pitching cylinders 20A and 20B via the first and second direction control valves 35 and 36. The discharge circuit of a first support hydraulic pump 40B is connected to the discharge circuit of the first hydraulic pump 40A via a first support solenoid valve 33. Likewise, the discharge circuit of a second support hydraulic pump 41B is connected to the discharge circuit of the second hydraulic pump 41A via a second support solenoid valve 34.

A dumping pitch selector switch 27 and a carrying pitch selector switch 26 are respectively connected to the bulldozer blade pitch controller 50, i.e., a suitable control means. The signals issued from the controller 50 are applied to the first and second support solenoid valves 33 and 34, a dumping pitch control valve 30 serving as an electromagnetic hydraulic controller, a carrying pitch control valve 31, and a pitch/tilt selector valve 32.

The discharging circuit of a pilot pump 29 is connected to a pilot pressure control valve 28 of a control lever 25. The pilot pressure control valve 28 is connected to the dumping pitch control valve 30 and the carrying pitch control valve 31, and to the second direction control valve 36 via the pitch/tilt selector valve 32. The pilot pressure control valve 28 is connected also to the first direction control valve 35 via the dumping pitch control valve 30 and the carrying pitch control valve 31.

The bulldozer blade pitch controller 50 receives the signals from the sensors 23*a*, 23*b*, 2*a*, 2*b*, 21*a*, 21*b*, 24*a*, and 24*b* which have been described in conjunction with FIG. 3 and FIG. 4.

The operation of the embodiment will now be described.

When the carrying pitch switch 26 of the control lever 25 is turned ON, the carrying pitch control valve 31 is shifted from its position A to its position B, the pitch/tilt solenoid selector valve 32 is shifted from its position A to its position B, and a command signal from the controller 50 is supplied to the first and second support solenoid valves 33 and 34 to change each of them over from its position A to its position B. This causes the discharge flow from the first support hydraulic pump 40B to merge with the flow in the discharge pipe of the first hydraulic pump 40A, and causes the discharge flow from the second support hydraulic pump 41B to merge with the flow in the discharge pipe of the second hydraulic pump 41A. At this time, the pilot pressure from the pilot pump 29 is applied from the position B of the carrying pitch control valve 31 to the control section of the second direction control valve 36 via the pitch/tilt selector valve 32, and from the position B of the carrying pitch control valve 31 to the control section of the first direction control valve 35. This, in turn, causes each of the first and second direction control valves 35 and 36 to be shifted to its position A; therefore, the pressurized oil discharged from the first hydraulic pump 40A passes through the first direction control valve 35 and flows into the bottom chamber of the left pitching cylinder 20A, while the pressurized oil discharged from the second hydraulic pump 41A passes through the second direction control valve 36 and flows into the bottom chamber of the right pitching cylinder 20B. Thus, the left and right pitching cylinders 20A and 20B extend simultaneously to thereby quickly set the bulldozer blade 10 to the dumping pitch, i.e., to quickly tilt it forwardly.

When the dumping pitch switch 27 of the control lever 25 is turned ON, the dumping pitch control valve 30 is shifted from its position A to its position B, the pitch/tilt solenoid selector valve 32 is shifted from its position A to its position B, and a command signal from the controller 50 is supplied to the first and second support solenoid valves 33 and 34 to change each of them over from its position A to its position B. This causes the discharge flow from the first support hydraulic pump 40B to merge with the flow in the discharge pipe of the first hydraulic pump 40A and causes the discharge flow from the second support hydraulic pump 41B to merge with the flow in the discharge pipe of the second hydraulic pump 41A. At this time, the pilot pressure from the pilot pump 29 is applied from the position B of the dumping pitch control valve 30 to the control section of the second direction control valve 36 via the pitch/tilt selector valve 32, and from the position B of the dumping pitch control valve 30 to the control section of the first direction control valve 35. This, in turn, causes each of the first and second direction control valves 35 and 36 to be shifted to its position B; therefore, the pressurized oil discharged from the first hydraulic pump 40A passes through the first direction control valve 35 and flows into the head chamber of the left pitching cylinder 20A, while the pressurized oil discharged from the second hydraulic pump 41A passes through the second direction control valve 36 and flows into the head chamber of the right pitching cylinder 20B. Thus, the left and right pitching cylinders 20A and 20B retract simultaneously to thereby quickly set the bulldozer blade 10 to the carrying pitch, i.e., to quickly tilt it backwardly.

Thus, the bulldozer blade 10 can be set to the dumping pitch, i.e., it can be inclined forwardly, and to the carrying pitch, i.e., it can be inclined backwardly. The yokes 22A and 22B, of the left and right lifting cylinders 21A and 21B, move circularly to set the bulldozer blade 10 in the excavating pitch, the dumping pitch, or the carrying pitch described in conjunction with FIG. 1. The angles of the circular movement of the yokes 22A and 22B are detected by the yoke angle sensors 23A and 23B and the detection signals are applied to the controller 50. The controller 50 calculates and stores beforehand the target values of the excavating pitch, the dumping pitch, and the carrying pitch of the bulldozer blade 10.

When the bulldozer 20 is traveling backwardly after it has completed an operation of excavating, carrying, or dumping earth, and the bulldozer blade 10 is being raised or has reached a predetermined level relative to the ground surface, the controller 50 issues a command to the dumping pitch control valve 30, the carrying pitch control valve 31, and the pitch/tilt selector valve 32 to open them. This switches the first and second direction selector valves 35 and 36 to the same direction at the same time, and pressurized oil, which is discharged from the first and second hydraulic pumps 40A and 41A, drives the left and right pitching cylinders 20A and 20B so as to automatically set the bulldozer blade 10 to the excavating pitch. As soon as the rotational angle for the excavating pitch of the bulldozer blade 10 has reached the target value, the controller 50 stops issuing the command.

When the bulldozer 20 is repeatedly traveling forwardly and backwardly, the following procedure is taken to prevent the bulldozer blade 10 from being set for the excavating pitch against the operator's will: it is determined whether the bulldozer 20 is moving backwardly, after completing the operation of excavating, carrying, or dumping, by detecting the difference between the input rpms and the output rpms of the torque converter 2, and the bulldozer blade 10 is reset to the predetermined excavating pitch only when the determination result is affirmative. Further, when the operator needs to start moving the bulldozer 20 forwardly while the bulldozer blade 10 is being reset to the predetermined excavating pitch, the operator momentarily presses the carrying pitch switch 26 or the dumping pitch switch 27 again and quickly releases it by clicking it so as to interrupt the resetting of the bulldozer blade 10 to the predetermined excavating pitch.

The methods for controlling the pitch of the bulldozer blade 10 in accordance with the embodiment will now be described in detail in conjunction with the steps S1 through S9, shown in the flowcharts of FIG. 6 through FIG. 13.

Figure 6:
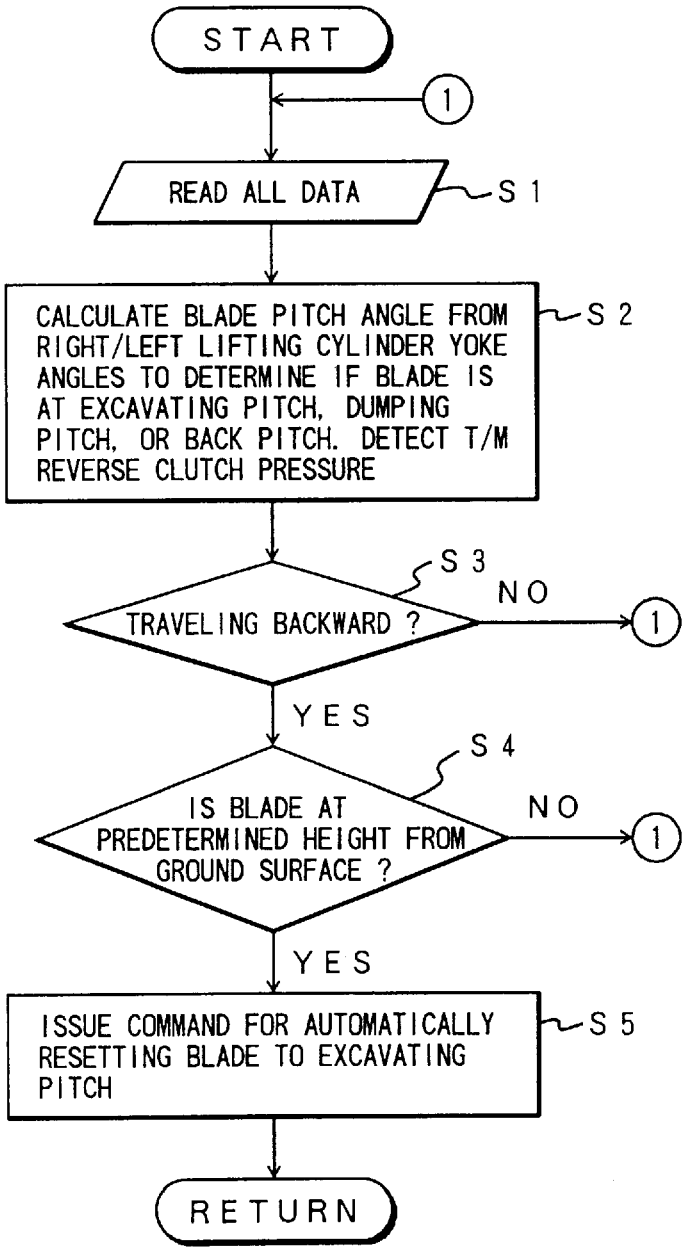
FIG. 6 is a flowchart of a first bulldozer blade pitch control program in accordance with the embodiment.

Referring to FIG. 6, a first method for controlling the pitch of the bulldozer blade 10 will be described. In step S1, the controller 50 reads all data received from the sensors 23*a*, 23*b*, 2*a*, 2*b*, 21*a*, 21*b*, 24*a*, 24*b*, and 47*a* through 47*e*, and calculates, in step S2, the pitch angle of the bulldozer blade 10 from the yoke angles of the left and right lifting cylinders 21A and 21B so as to determine whether the bulldozer blade 10 is at the excavating pitch, the dumping pitch, or the carrying pitch. The controller 50 also detects the pressure of the reverse clutch 3*b* of the transmission 60, and, based on the detected pressure, the controller 50 determines, in step S3, whether the bulldozer 20 is traveling backwardly. If the controller 50 decides that the bulldozer 20 is not traveling backwardly, then the controller 50 returns to step S1; or if the controller 50 decides that the bulldozer 20 is traveling backwardly, then the controller 50 proceeds to step S4 where it further determines whether the bulldozer blade 10 is at a predetermined height from the ground surface. If the controller 50 determines that the bulldozer blade 10 is not at the predetermined height, then the controller 50 returns to step S1; or if the controller 50 determines that the bulldozer blade 10 is at the predetermined height, then it proceeds to step S5 wherein it sets the bulldozer blade 10 to the excavating pitch. In this case, the predetermined height of the bulldozer blade 10 has been set such that the bulldozer blade 10 does not bump against boulders or the like while the bulldozer 20 is backing.

Figure 7:
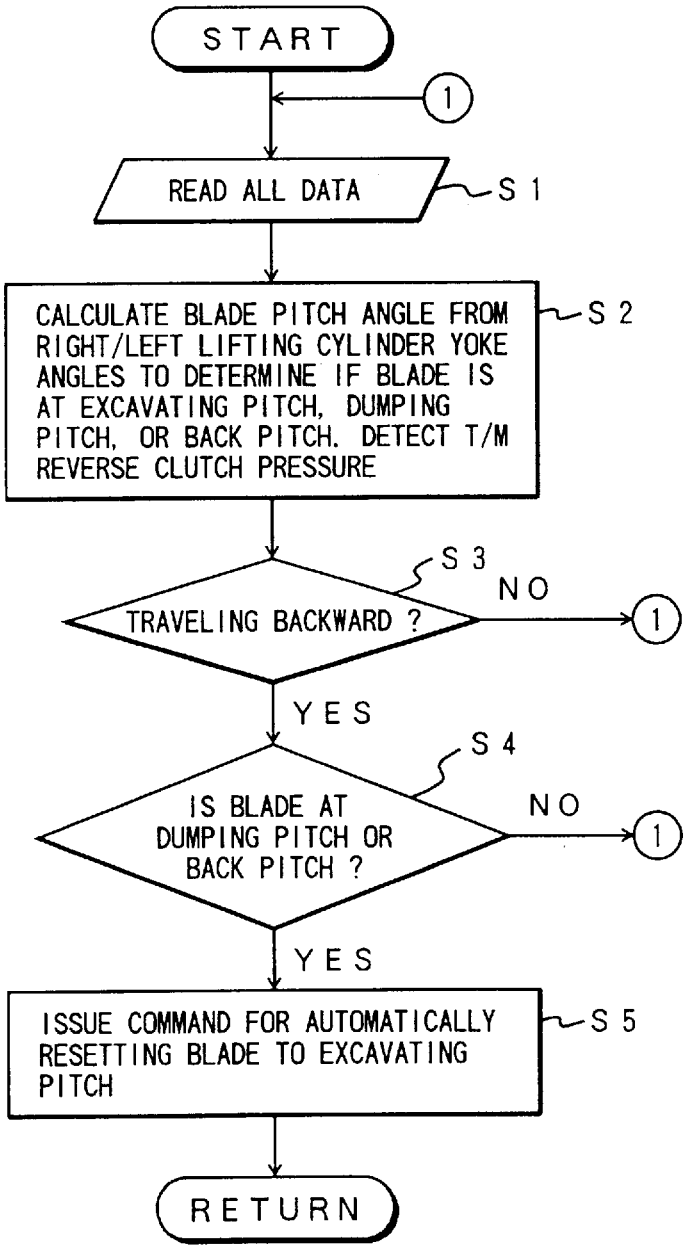
FIG. 7 is a flowchart of a second bulldozer blade pitch control program in accordance with the embodiment.

A second method for controlling the pitch of the bulldozer blade 10 will now be described in conjunction with FIG. 7. Steps S1 through S3 are the same as those of the first method; therefore, the description for these steps will not be repeated.

If the judgment result in step S3 is affirmative, then the controller 50 goes to step S4 wherein the controller 50 determines whether the bulldozer blade 10 is at the dumping pitch or the carrying pitch, and if the controller 50 decides that the bulldozer blade 10 is not at either of those pitches, then the controller 50 returns to step S1. If the controller 50 determines that the bulldozer blade 10 is at the dumping pitch on the carrying pitch, then the controller 50 proceeds to step S5 wherein the controller 50 sets the bulldozer blade 10 to the excavating pitch.

Figure 8:
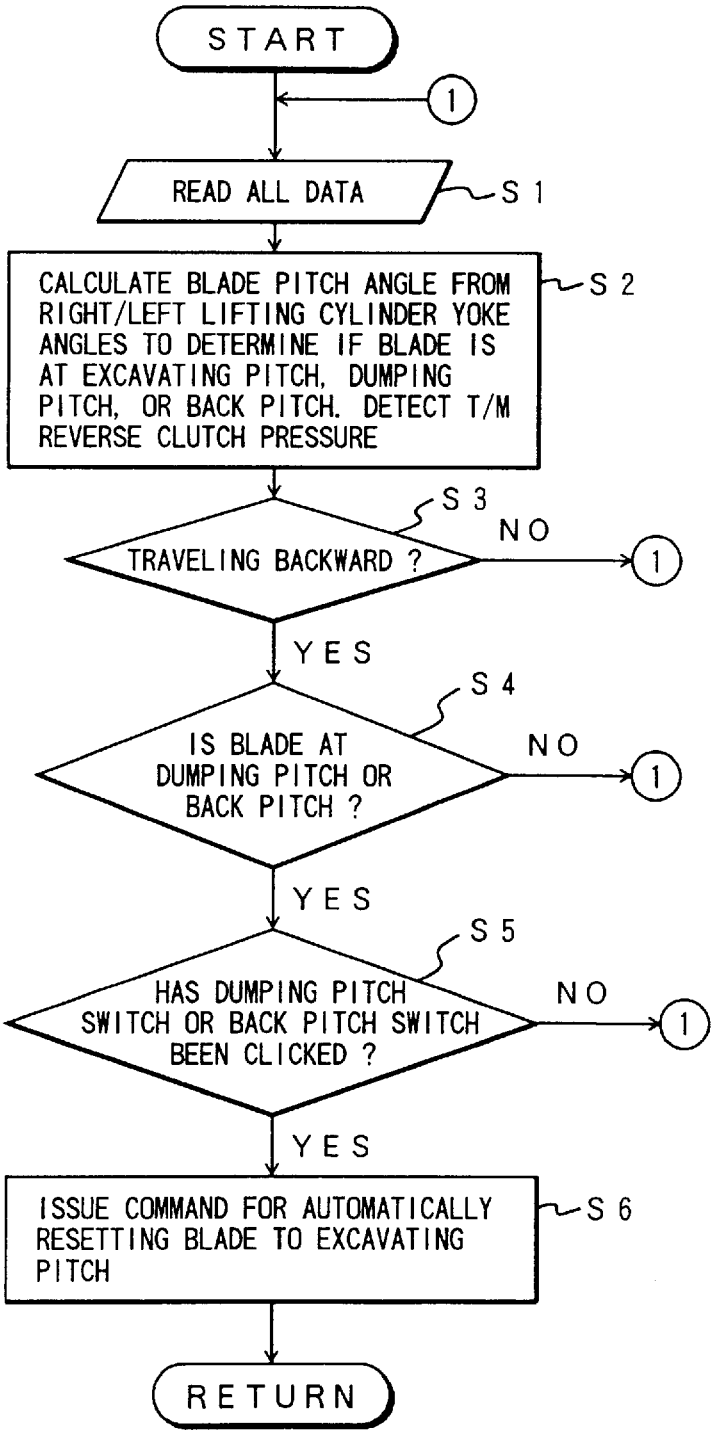
FIG. 8 is a flowchart of a third bulldozer blade pitch control program in accordance with the embodiment.

A third method for controlling the pitch of the bulldozer blade 10 will be described with reference to FIG. 8. The procedure from steps S1 through S4 is the same as that of the second method; hence, the description thereof will not be repeated.

If the controller 50 decides in step S4 that the bulldozer blade 10 is at the dumping pitch or the carrying pitch, then the controller 50 proceeds to step S5, wherein the controller 50 further determines whether the carrying pitch switch 26 or the dumping pitch switch 27 has been clicked. If the controller 50 determines in step S5 that neither the carrying pitch switch 26 nor the dumping pitch switch 27 has been clicked, then the controller 50 returns to step S1; or if the controller 50 determines that either of the switches has been clicked, then the controller 50 goes to step S6, wherein the controller 50 sets the bulldozer blade 10 to the excavating pitch.

Figure 9:
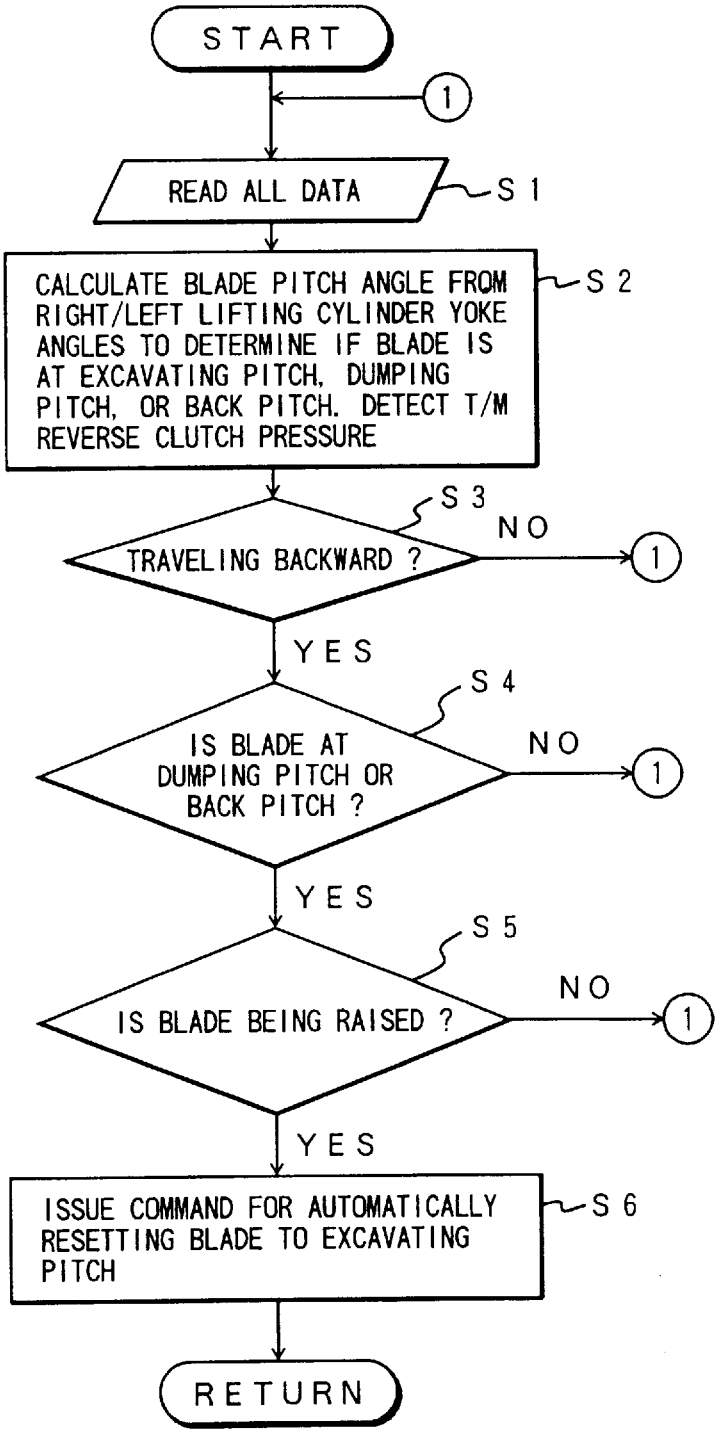
FIG. 9 is a flowchart of a fourth bulldozer blade pitch control program in accordance with the embodiment.

A fourth method for controlling the pitch of the bulldozer blade 10 will be described with reference to FIG. 9. The procedure from steps S1 through S4 is the same as that of the second method, so that the description thereof will not be repeated.

If the controller 50 decides in step S4 that the bulldozer blade 10 is at the dumping pitch or the carrying pitch, then the controller 50 proceeds to step S5 wherein the controller 50 further determines whether the bulldozer blade 10 is being raised. If the controller 50 decides in step S5 that the bulldozer blade 10 is not being raised, then the controller 50 returns to step S1; or if the controller 50 decides that the bulldozer blade 10 is being raised, then the controller 50 proceeds to step S6 wherein the controller 50 sets the bulldozer blade 10 to the excavating pitch.

Figure 10:
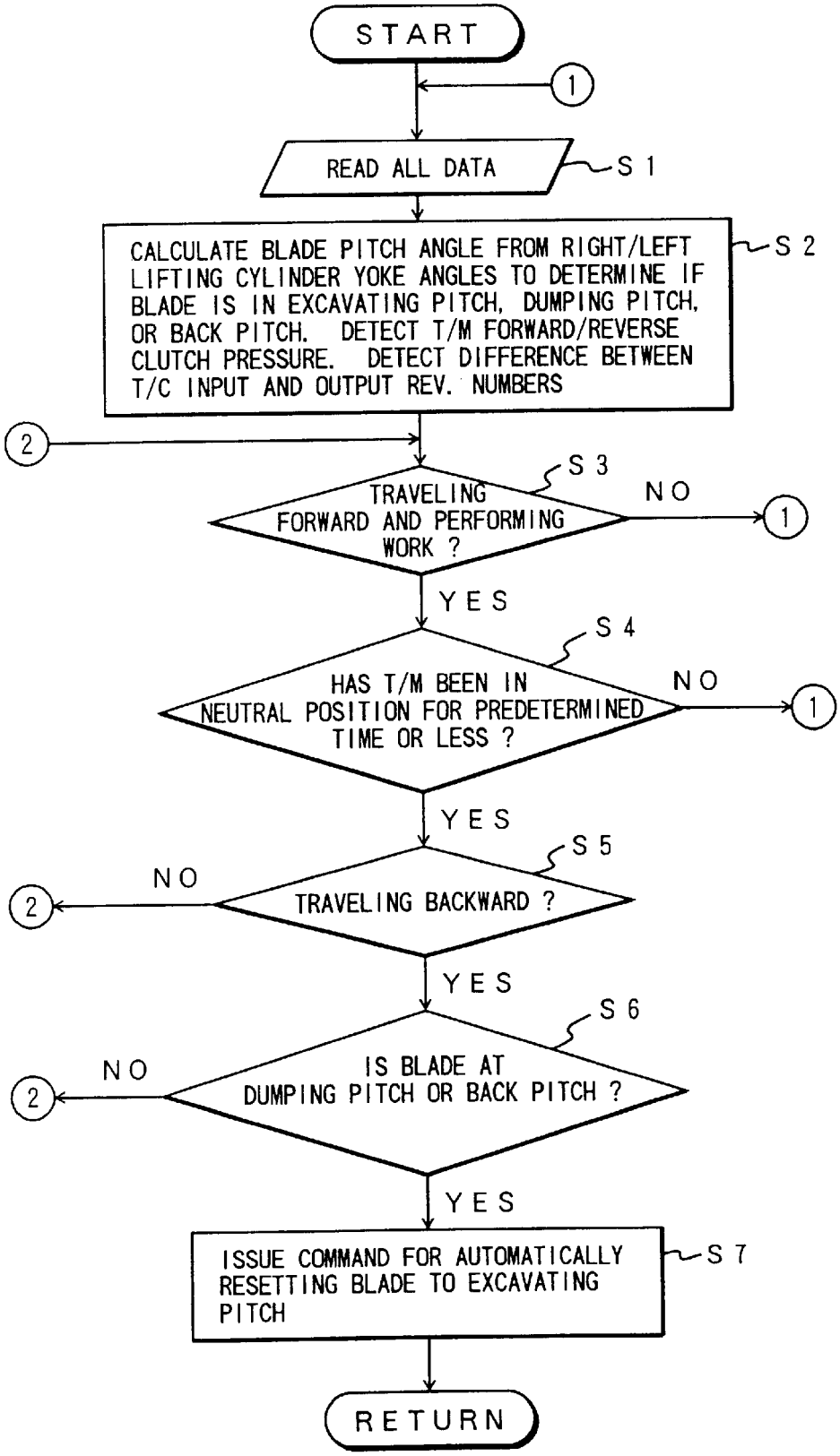
FIG. 10 is a flowchart of a fifth bulldozer blade pitch control program in accordance with the embodiment.

A fifth method for controlling the pitch of the bulldozer blade 10 will be described in conjunction with FIG. 10. Step S1 is the same as that of the first method, so that the description thereof will not be repeated.

In step S2, the controller 50 calculates the pitch angle of the bulldozer blade 10 from the yoke angles of the left and right lifting cylinders 21A and 21B so as to determine whether the bulldozer blade 10 is at the excavating pitch, the dumping pitch, or the carrying pitch. The controller 50 also detects the pressures of the forward clutch 3*a* and the reverse clutch 3*b* of the transmission 60 and detects the difference between the input rpm and the output rpm of the torque converter 2. In step S3, the controller 50 determines whether the bulldozer 20 is traveling forwardly or backwardly according to the detected pressure, and the controller 50 also determines whether the bulldozer 20 is performing work from the difference between the detected input rpm and the detected output rpm. The controller 50 actually judges whether the bulldozer 20 is performing work or traveling by detecting the tractive force of the bulldozer 20; the tractive force during work can be detected from the difference between the input rpm and the output rpm of the torque converter 2. In step S3, if the controller 50 decides that the bulldozer 20 is not traveling forwardly and performing work, then the controller 50 returns to step S1; if the controller 50 decides that the bulldozer 20 is traveling forwardly and performing work, then the controller 50 proceeds to step S4, wherein the controller 50 determines whether the transmission 60 has been set in the neutral position for a predetermined time or less. If the controller 50 decides that the transmission 60 has been set in the neutral position for more than the predetermined time, then the controller 50 returns to step S1, whereas the controller 50 proceeds to step S5 if the controller 50 determines that the transmission 60 has been set in the neutral position for the predetermined time or less. In step S5, the controller 50 determines whether the bulldozer 20 is traveling backwardly, and if the controller 50 determines that the bulldozer 20 is not traveling backwardly, then the controller 50 returns to step S3, whereas the controller 50 proceeds to step S6 if it determines that the bulldozer 20 is traveling backwardly. In step S6, the controller 50 judges whether the bulldozer blade 10 is at the dumping pitch or the carrying pitch, and if the controller 50 decides that the bulldozer blade 10 is at neither of those pitches, then it returns to step S3. If the controller 50 determines in step S6 that the bulldozer blade 10 is at the dumping pitch or the carrying pitch, then the controller 50 proceeds to step S7 wherein it sets the bulldozer blade 10 at the excavating pitch.

Figure 11:
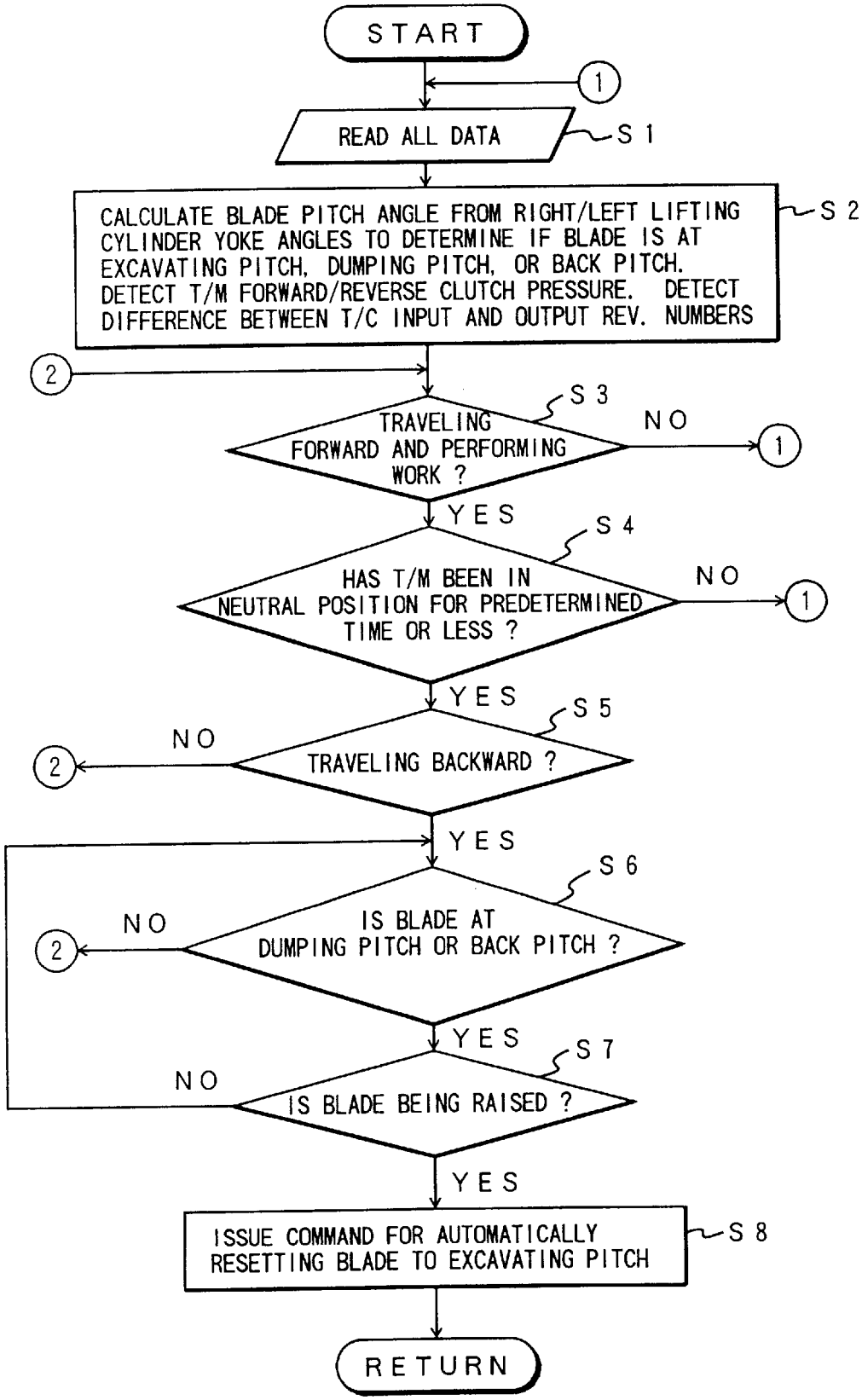
FIG. 11 is a flowchart of a sixth bulldozer blade pitch control program in accordance with the embodiment.

A sixth method for controlling the pitch of the bulldozer blade 10 will be described in conjunction with FIG. 11. Steps S1 through S6 are the same as those of the fifth method, so that the description thereof will not be repeated.

In step S6, if the controller 50 determines that the bulldozer blade 10 is at the dumping pitch or the carrying pitch, then the controller 50 goes to step S7 wherein it further determines whether the bulldozer blade 10 is being raised. If the controller 50 determines in step S7 that the bulldozer blade 10 is not being raised, then the controller 50 returns to step S6, whereas the controller 50 proceeds to step S8 wherein it sets the bulldozer blade 10 to the excavating pitch if the determination result of step S7 is affirmative.

Figure 12:
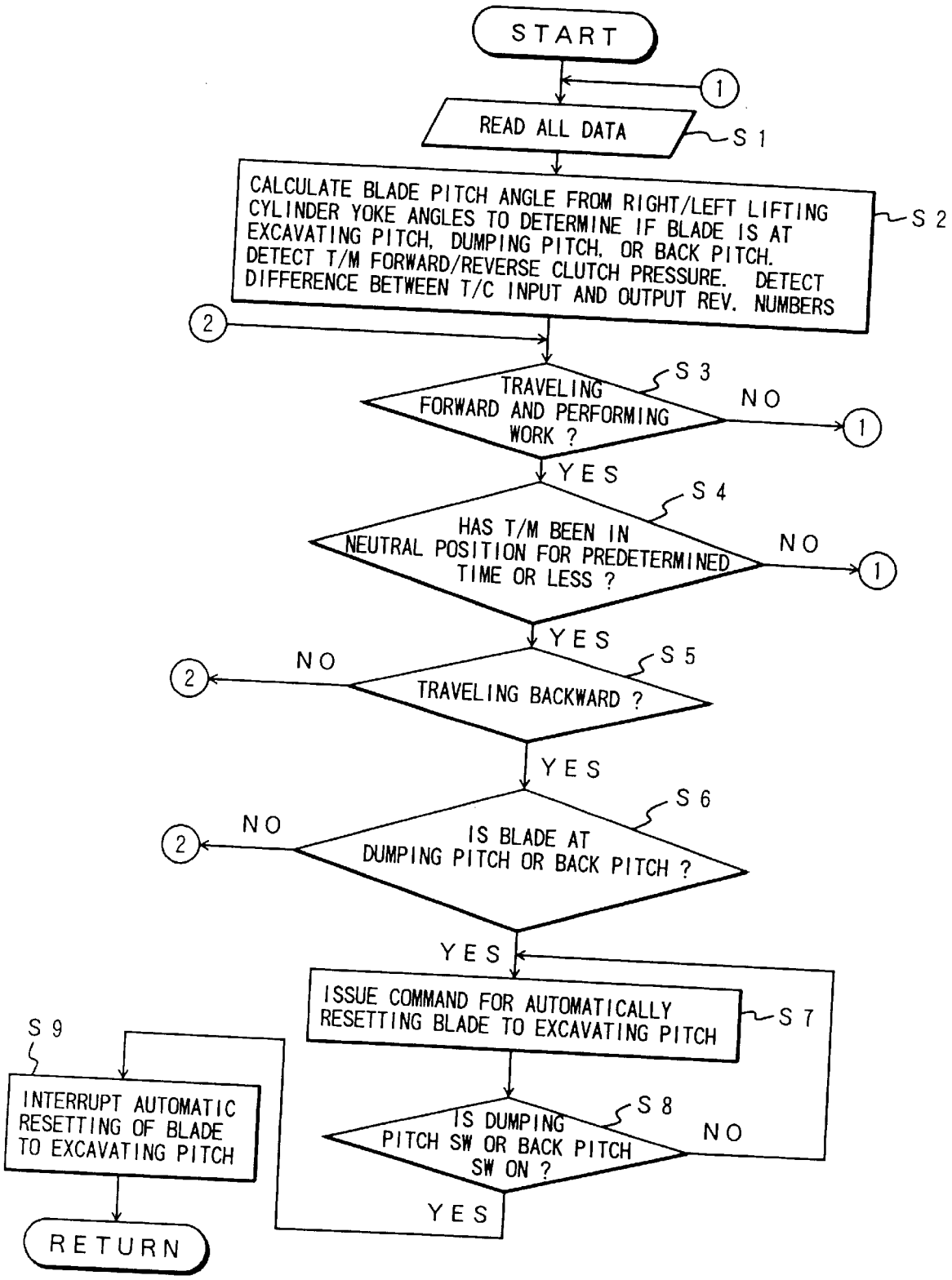
FIG. 12 is a flowchart of a seventh bulldozer blade pitch control program in accordance with the embodiment.

A seventh method for controlling the pitch of the bulldozer blade 10 will be described with reference to FIG. 12. Steps S1 through S6 are the same as those of the fifth method, so that the description thereof will not be repeated.

If the controller 50 determines in step S6 that the bulldozer blade 10 is at the dumping pitch or the carrying pitch, then the controller 50 proceeds to step S7 to set the bulldozer blade 10 at the excavating pitch. In step S8, the controller 50 judges whether the dumping pitch switch 27 or the carrying pitch switch 26 is ON, and if the controller 50 determines that neither of them is ON, then it returns to the step S7. If the controller 50 determines in step S8 that either of them is ON, then it proceeds to step S9 wherein it interrupts the operation of setting the bulldozer blade 10 to the excavating pitch.

Figure 13:
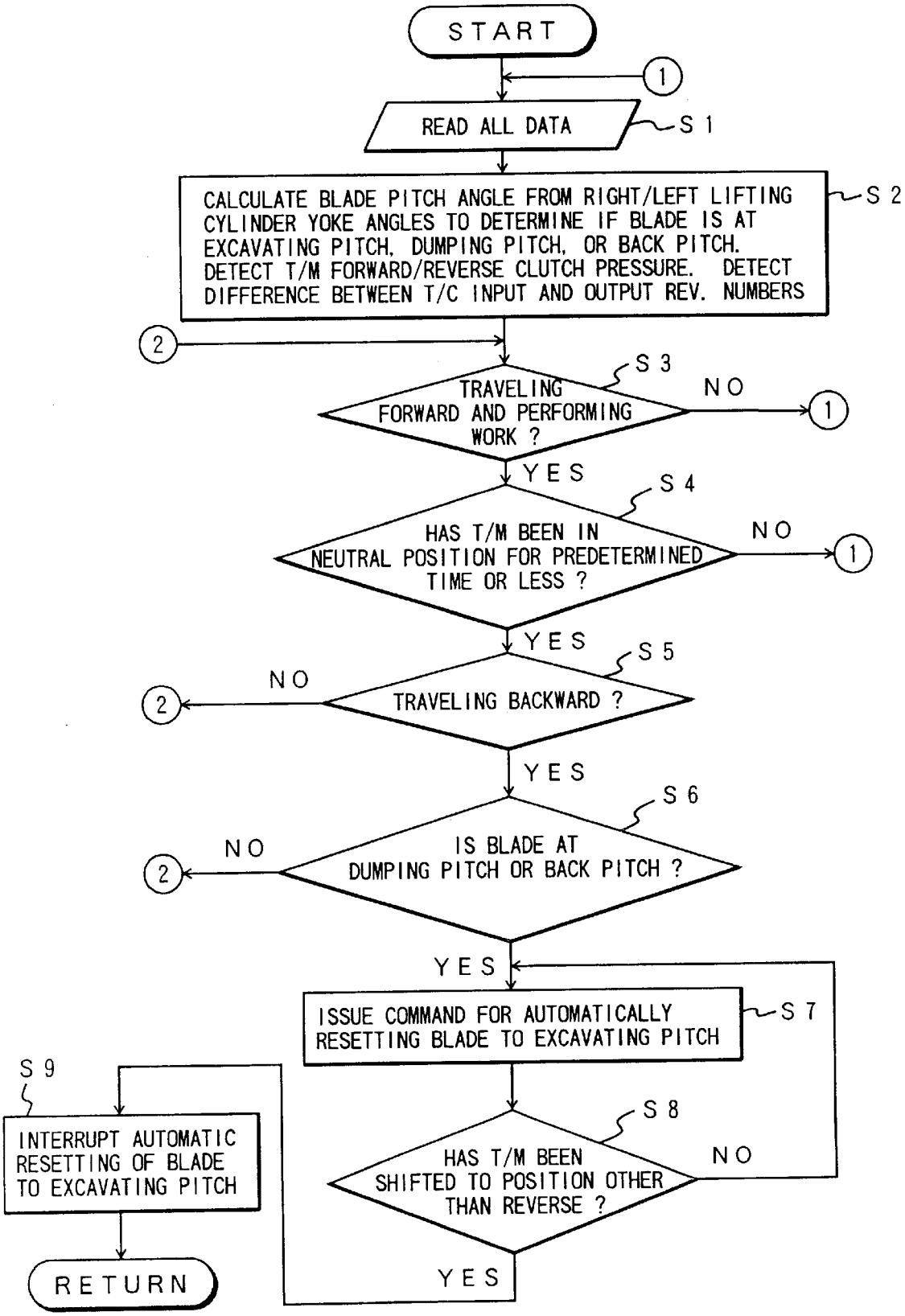
FIG. 13 is a flowchart of an eighth bulldozer blade pitch control program in accordance with the embodiment.

An eighth method for controlling the pitch of the bulldozer blade 10 will now be described in conjunction with FIG. 13. Steps from S1 to S7 are the same as those of the seventh method, and the description thereof will not be repeated.

After setting the bulldozer blade 10 to the excavating pitch in step S7, the controller 50 determines in step S8 whether the setting of the transmission 60 has been shifted to a position other than the reverse speed position; if the controller 50 determines that the transmission has been shifted to the reverse speed position, then the controller 50 returns to step S7, or if the controller 50 determines that the transmission has been shifted to a position other than the reverse speed position, then the controller 50 proceeds to step S9 to interrupt the operation of setting the bulldozer blade 10 to the excavating pitch.

According to the present invention, the bulldozer blade 10 is set at the excavating pitch, the carrying pitch, or the dumping pitch when excavating, carrying earth, or dumping earth while the bulldozer 20 is traveling forwardly, and the bulldozer blade 10 is automatically set to the excavating pitch when traveling backwardly to return to an original excavating point after finishing an operation of excavating, carrying, or dumping work. Thus, during the backward travel, the operator of the bulldozer 20 is enabled to concentrate on looking backwardly to check for obstacles behind the bulldozer 20 and also on controlling the control lever. This permits greater ease of operation of the bulldozer blade 10 and also improves safety.

Reasonable variations and modifications to the invention are within the scope of the foregoing description and the appended claims to the invention.

What is claimed is:

1. A bulldozer blade pitch control method for setting a bulldozer blade on a bulldozer to an excavating pitch, a carrying pitch, or a dumping pitch when excavating, carrying, or dumping earth, respectively, while the bulldozer is traveling forwardly, said bulldozer blade being attached to leading ends of frame members which are mounted on opposite sides of a body of the bulldozer in such a manner that said bulldozer blade can swing longitudinally, said bulldozer blade being attached to said body by left and right lifting cylinders; said method comprising the steps of:

detecting rotational angles of the left and right lifting cylinders while said bulldozer is traveling backwardly after the bulldozer has completed an operation of excavating, carrying, or dumping earth;

providing a control signal responsive to the thus detected rotational angles; and automatically resetting said bulldozer blade, from said carrying pitch or said dumping pitch to a predetermined excavating pitch which is desired for a next excavation to be performed during a subsequent forward travel, in response to the control signal.

2. A bulldozer blade pitch control method in accordance with claim 1, further comprising:

determining whether said bulldozer blade is being raised while said bulldozer is traveling backwardly; and wherein said step of automatically resetting said bulldozer blade is conducted when said bulldozer blade is being raised while said bulldozer is traveling backwardly.

3. A bulldozer blade pitch control method in accordance with claim 1, further comprising:

determining whether said bulldozer blade has reached a predetermined height relative to the ground while said bulldozer is traveling backwardly; and wherein said step of automatically resetting said bulldozer blade is conducted when said bulldozer blade has reached said predetermined height while said bulldozer is traveling backwardly.

4. A bulldozer blade pitch control method in accordance with claim 1, wherein said bulldozer is provided with a carrying pitch switch for setting said bulldozer blade to said carrying pitch; and wherein said step of automatically resetting said bulldozer blade is conducted when said carrying pitch switch is actuated while said bulldozer is traveling backwardly.

5. A bulldozer blade pitch control method in accordance with claim 1, wherein said bulldozer is provided with a dumping pitch switch for setting said bulldozer blade to said dumping pitch; and wherein said step of automatically resetting said bulldozer blade is conducted when said dumping pitch switch is actuated while said bulldozer is traveling backwardly.

6. A bulldozer blade pitch control method in accordance with claim 1, wherein said bulldozer is provided with a transmission, and wherein said method further comprises the steps of:

determining if a command other than one for backward travel is supplied to the transmission while said bulldozer blade is being reset to said excavating pitch, and interrupting the resetting of said bulldozer blade to said excavating pitch if it is determined that a command other than one for backward travel has been supplied to the transmission while said bulldozer blade is being reset to said excavating pitch.

7. A bulldozer blade pitch control method for setting a bulldozer blade to an excavating pitch, a carrying pitch, or a dumping pitch when excavating, carrying, or dumping earth, respectively, by turning ON a carrying pitch switch or a dumping pitch switch while a bulldozer is traveling forwardly, said bulldozer blade being attached to leading ends of frame members which are mounted on opposite sides of a vehicle body of said bulldozer in such a manner that said bulldozer blade can swing longitudinally; said method comprising the steps of:

commencing an automatic resetting of said bulldozer blade to said excavating pitch responsive to a pressing of said carrying pitch switch or said dumping pitch switch; and interrupting the resetting of said bulldozer blade to said excavating pitch if said carrying pitch switch or said dumping pitch switch is again pressed and released while said bulldozer blade is being automatically reset from said carrying pitch or said dumping pitch to a predetermined excavating pitch while said bulldozer is traveling backwardly.

8. A bulldozer blade pitch control apparatus for setting a bulldozer blade on a bulldozer to an excavating pitch, a carrying pitch, or a dumping pitch when excavating, carrying, or dumping earth while the bulldozer is traveling forwardly, wherein said bulldozer blade is attached to leading ends of frame members which are mounted on opposite sides of a vehicle body of the bulldozer in such a manner that said bulldozer blade can swing longitudinally, said bulldozer having a transmission; said bulldozer blade pitch control apparatus comprising:

first detectors for detecting if said bulldozer blade is in said excavating pitch, said carrying pitch, or said dumping pitch;

second detectors for detecting if the transmission has been set for forward or backward travel and for detecting the position of a speed gear;

an electromagnetic hydraulic controller for setting said bulldozer blade; and a bulldozer blade pitch controller for issuing a command to said electromagnetic hydraulic controller for setting said bulldozer blade to said predetermined excavating pitch in response to signals received from said first and second detectors while said bulldozer is traveling backwardly.

9. A bulldozer blade pitch control apparatus in accordance with claim 8, further comprising:

tractive force detectors for detecting tractive force of said bulldozer when said bulldozer excavates or carries earth; and wherein said bulldozer blade pitch controller issues a command to said electromagnetic hydraulic controller to set said bulldozer blade to said predetermined excavating pitch if the detected tractive force is a predetermined value or more and said transmission has been shifted to a backward travel position from a neutral position within a predetermined time so that said bulldozer begins to travel backwardly.

10. A bulldozer blade pitch control apparatus in accordance with claim 8, further comprising:

third detectors for detecting a raising operation of said bulldozer blade; and wherein said bulldozer blade pitch controller issues, in response to signals received from said first, second, and third detectors, a command to said electromagnetic hydraulic controller to set said bulldozer blade to a predetermined excavating pitch while said bulldozer is traveling backwardly.

11. A bulldozer blade pitch control apparatus in accordance with claim 10, further comprising:

tractive force detectors for detecting tractive force of said bulldozer when said bulldozer excavates or carries earth; and wherein said bulldozer blade pitch controller issues, in response to signals received from said first, second, third, and tractive force detectors, a command to said electromagnetic hydraulic controller to set said bulldozer blade to a predetermined excavating pitch while said bulldozer is traveling backwardly if the detected tractive force is a predetermined value or more and said transmission has been shifted to a backward travel position from a neutral position within a predetermined time and said bulldozer begins to travel backwardly.

12. A bulldozer blade pitch control apparatus in accordance with claim 8, further comprising:

third detectors for detecting a height of said bulldozer blade from the ground surface; and wherein said bulldozer blade pitch controller issues, in response to signals received from said first, second, and third detectors, a command to said electromagnetic hydraulic controller to set said bulldozer blade to a predetermined excavating pitch while said bulldozer is traveling backwardly.

13. A bulldozer blade pitch control apparatus in accordance with claim 12, further comprising:

tractive force detectors for detecting tractive force of said bulldozer when said bulldozer excavates or carries earth; and wherein said bulldozer blade pitch controller issues, in response to signals received from said first, second, third, and tractive force detectors, a command to said electromagnetic hydraulic controller to set said bulldozer blade to a predetermined excavating pitch while said bulldozer is traveling backwardly if the detected tractive force is a predetermined value or more and said transmission has been shifted to a backward travel position from a neutral position within a predetermined time and said bulldozer begins to travel backwardly.

* * * * *